United States Patent [19]

Mineck

[11] 4,198,358

[45] Apr. 15, 1980

[54] CARBURETOR WITH SELF ADJUSTING DOUBLE VENTURI

[75] Inventor: Fred Mineck, Phoenix, Ariz.

[73] Assignees: Dorothy J. Archer, Phoenix, Ariz.; Jay A. Mineck, Montclair, Calif. ; part interest to each

[21] Appl. No.: 656,290

[22] Filed: Feb. 9, 1976

[51] Int. Cl.[2] ..... F02M 7/22; F02M 1/02

[52] U.S. Cl. ..... 261/50 A; 261/52

[58] Field of Search ..... 261/50 A, 52

[56] References Cited

U.S. PATENT DOCUMENTS

| | | | |
|---|---|---|---|
| 1,049,887 | 1/1913 | Marsh | 261/50 A |
| 1,356,661 | 10/1920 | Schulz | 261/50 A |
| 1,439,573 | 12/1922 | Orem | 261/50 A |
| 2,868,522 | 1/1959 | O'Neil | 261/50 A |
| 3,920,778 | 11/1975 | De Rugeris | 261/50 A |

FOREIGN PATENT DOCUMENTS

| | | | |
|---|---|---|---|
| 435768 | 9/1935 | United Kingdom | 261/50 A |

*Primary Examiner*—Frank W. Lutter
*Assistant Examiner*—Gregory N. Clements
*Attorney, Agent, or Firm*—Warren F. B. Lindsley

[57] ABSTRACT

An improved carburetor for an internal combustion engine, the carburetor being simplified in construction over the prior art carburetors and incorporating versatility through the use of a self-adjusting double venturi which permits the carburetor to operate effectively over a wide range of operating conditions. Parts with bearing surfaces are lubricated by gasoline and are located where they will not be contaminated by dust carried by airflow through the carburetor.

4 Claims, 8 Drawing Figures

CARBURETOR WITH SELF ADJUSTING DOUBLE VENTURI

BACKGROUND OF THE INVENTION

One of the most important parts of an internal combustion engine is its carburetor. Unless the carburetor performs well the engine will not start reliably, will not run smoothly and deliver adequate power and good gasoline mileage, and will produce excessive atmospheric pollutants.

Because the proper operation of the carburetion system is so essential to total engine performance, much attention has been given in the past to carburetor design and over the years the carburetor has become a complex device.

The complexity of the modern carburetor is apparent when it is recognized that the typical carburetor system employs six separate systems i.e. a float system for controlling the level of fuel in the bowl; a low speed or idling system to provide an adequate fuel supply when air intake is low; a high speed or cruising system utilizing the venturi; an accelerating pump system to overcome fuel inertia during a sudden increase in power demand; a power system to provide adequate fuel under conditions of reduced vacuum resulting from the opening of the throttle; and a choke system for increasing the fuel-to-air ratio under starting or low temperature conditions.

In addition there are anti-percolation vents, hot idle compensators, anti-dieseling solenoids, deceleration controls in most modern carburetors.

This multitudue of special systems and features requires careful adjustment and maintenance and the many small ducts and valves are vulnerable to blockage and wear by dust and dirt finding their way through the air filter.

Furthermore, until recently there has been a greater emphasis on certain aspects of performance such as starting, acceleration and power developed with insufficient emphasis given to gasoline mileage and atmospheric polluting conditions.

Thus, a need exists for a new approach to carburetor design which will produce a better balance in total performance while utilizing a simpler design that does not require the numerous separate systems and special accessories and which provides in particular improved gas mileage and a lower level of atmospheric pollution.

DESCRIPTION OF THE PRIOR ART

A British patent No. 435,768 issued Sept. 22, 1935 (Jacoby and Nussli) describes a simplified carburetor design utilizing a single self-adjusting venturi bearing similarities to the present invention but lacking certain features which are essential to the effective performance of the carburetor. The piston provided by Jacoby and Nussli did not have the proper contours essential to the promotion of turbulence as needed for the thorough mixing of fuel and air. There was no primary venturi to provide an air and fuel premixture prior to the introduction of fuel vapor at the one large venturi provided. Furthermore, some of the critical moving parts with intimate bearing surfaces were exposed to contamination by the air passing through the carburetor and there was no provision for cleaning of these surfaces by the gasoline supply.

An earlier version of the present invention overcome all but the last shortcoming of the British patent; in order to achieve a completely acceptable solution to the problem described, i.e. a totally successful alternative to the excessively complex and expensive design currently in use, the contamination problem must also be corrected.

SUMMARY OF THE INVENTION

In accordance with the invention claimed, an improved and greatly simplified carburetor is provided which utilizes a completely different approach to meet the full range of operating requirements.

It is therefore one object of this invention to provide an improved carburetor for an internal combustion engine.

Another object of this invention is to provide an improved carburetor which is much simpler in construction and operation than the known carburetors utilized in modern automobiles.

A further object of this invention is to provide an improved carburetor in which the number of moving parts is drastically reduced.

A still further object of this invention is to provide an improved carburetor in which the several separate systems of the known carburetors are virtually reduced to a single system which functions properly over a wide range of operating conditions.

A still further object of this invention is to provide in such a carburetor a means for sealing off the fuel supply when the engine stops running, thereby eliminating evaporation and the associated atmospheric pollution.

A still further object of this invention is to incorporate in the design of the carburetor a self-adjusting venturi which insures a high speed air stream for fuel and air mixing at all engine speeds.

A still further object of this invention is to provide a new and improved carburetor which eliminates the need for accelerating pumps, idle jets, automatic chokes, anti-percolation vents, anti-dieseling solenoids and the like.

A still further object of this invention is to provide an improved carburetor with effective fuel and air mixing capabilities yielding more finely divided fuel droplets than heretofore possible thoroughly dispersed in the air stream accomplished through the provision of an enlarged venturi area which is automatically controlled for optimum performance at all engine speeds.

A still further object of this invention is to provide an 18 to 1 air-to-fuel ratio compared with typical values for conventional carburetors of 15 to 1, the higher ratio being tolerated by more efficient mixing action resulting in improved fuel economy and reduced atmospheric pollution without destructive effects on the engine.

A still further object of this invention is to provide a carburetor in which all fuel mixing is accomplished ahead of the throttle plate, thereby realizing a more uniform distribution of fuel throughout the air body.

A still further object of this invention is to provide an improved inexpensive carburetor which can be economically disposed of at the end of its useful life as opposed to making costly repairs to prolong its life.

A still further object of this invention is to provide such a carburetor which utilizes only a single needle valve with sufficient movement to insure removal of any small foreign particles thereby eliminating or greatly reducing blockage or restriction of the fuel passage.

A still further object of this invention is to provide such a carburetor with a single and readily accessible vernier adjustment for optimizing its operation.

A still further object of this invention is to provide such a carburetor in which the bearing surfaces are located away from the airstream where they will not be contaminated by dust and dirt.

Yet another object of this invention is to locate such moving parts where they will be cleaned and lubricated by the gasoline passing through the carburetor.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
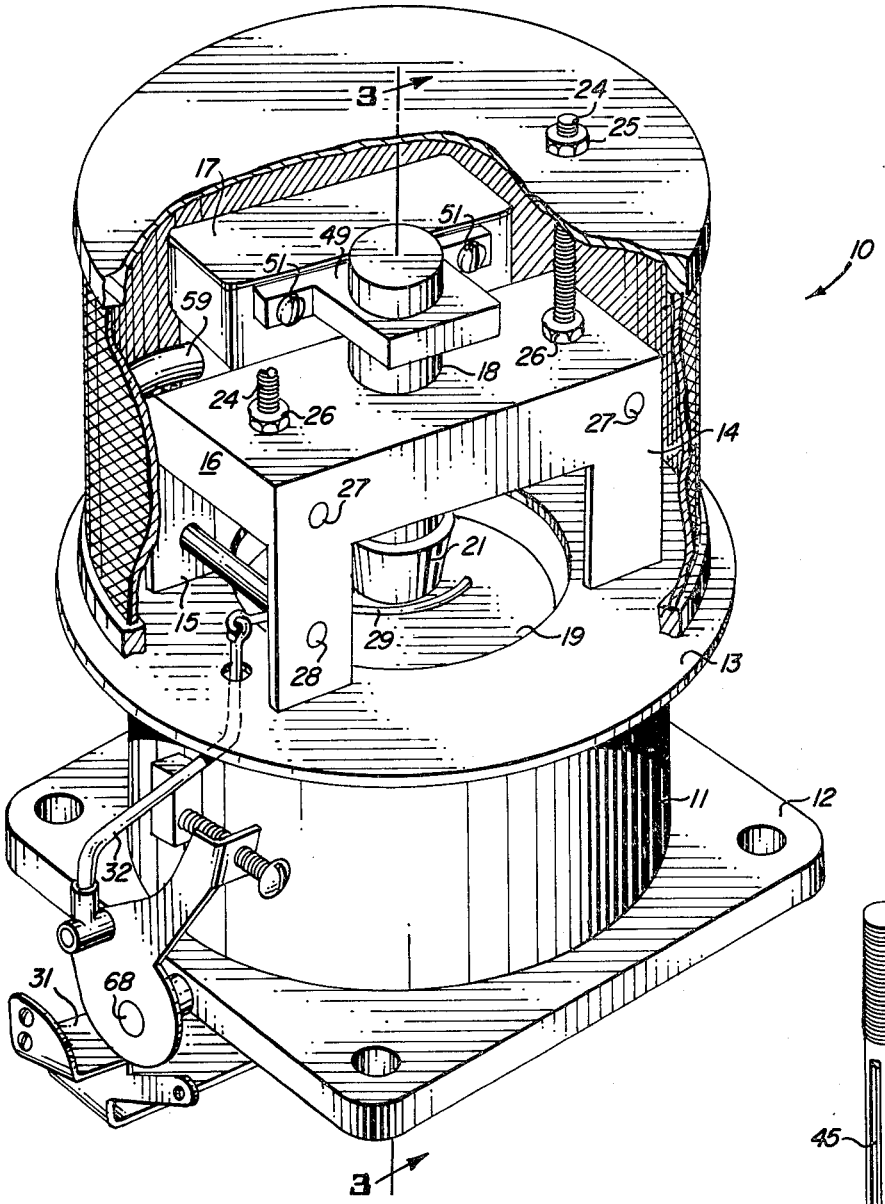
FIG. 1 is a perspective view of an improved carburetor embodying the invention with part of the housing broken away to reveal its structural details.

Referring more particularly to the drawing by characters of reference, FIGS. 1–5 disclose an improved carburetor 10 comprising a cylindrical carburetor body 11 rigidly secured between a conventional throttle plate 12 at one end and an open-centered disc-shaped air filter plate 13 at its other end. First and second fuel system support brackets 14 and 15 are provided each in the form of a flat U-shaped plate. An elongated rectangular block 16 is employed together to form a four-legged support for the fuel reservoir 17 and the fuel-metering column 18. A venturi piston assembly 19, its upward extension 21 enveloping the lower end of the fuel-metering column 18 moves vertically within body 11 under the control of vacuum acting against a coil spring 22. The spring 22 operates between the lower surface of piston assembly 19 and the upper surface of throttle plate 12. A conventional air filter 23 is secured to the filter plate 13 by two long vertically-oriented machine screws 24 and nuts 25, the screws 24 passing upward through holes in plate 13 and through aligned holes in block 16. A second pair of nuts 26 threaded over screws 24 are tightened against block 16 to secure block 16 and attached members 14, 15, 17 and 18 in a centered and aligned position atop plate 13.

The lower ends of bolts 24 are secured to throttle plate 12 and thus tie together all the main elements of the carburetor 10.

U-shaped plates 14 and 15 are utilized in inverted orientation, their side-members directed downward and their central horizontal members secured to opposite edges of block 16 by screws 27, the block 16 and the plates 14 and 15 thus forming a four-legged table-like support as described earlier for column 18 and reservoir 17. Between two legs of this table-like support a horizontal pivot pin 28 is mounted. Pivot pin 28 carries a fork-shaped choke lever 29 which is operated by throttle arm 31 through a connecting lever 32.

Figure 2:
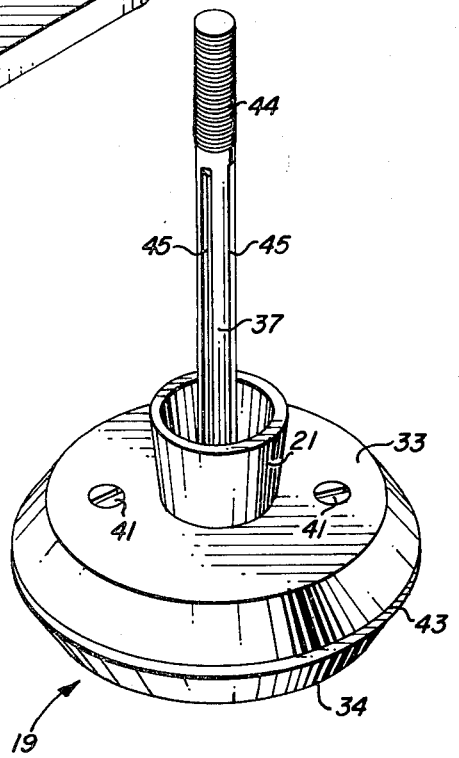
FIG. 2 is a perspective view of a key element of the carburetor of FIG. 1.
Figure 3:
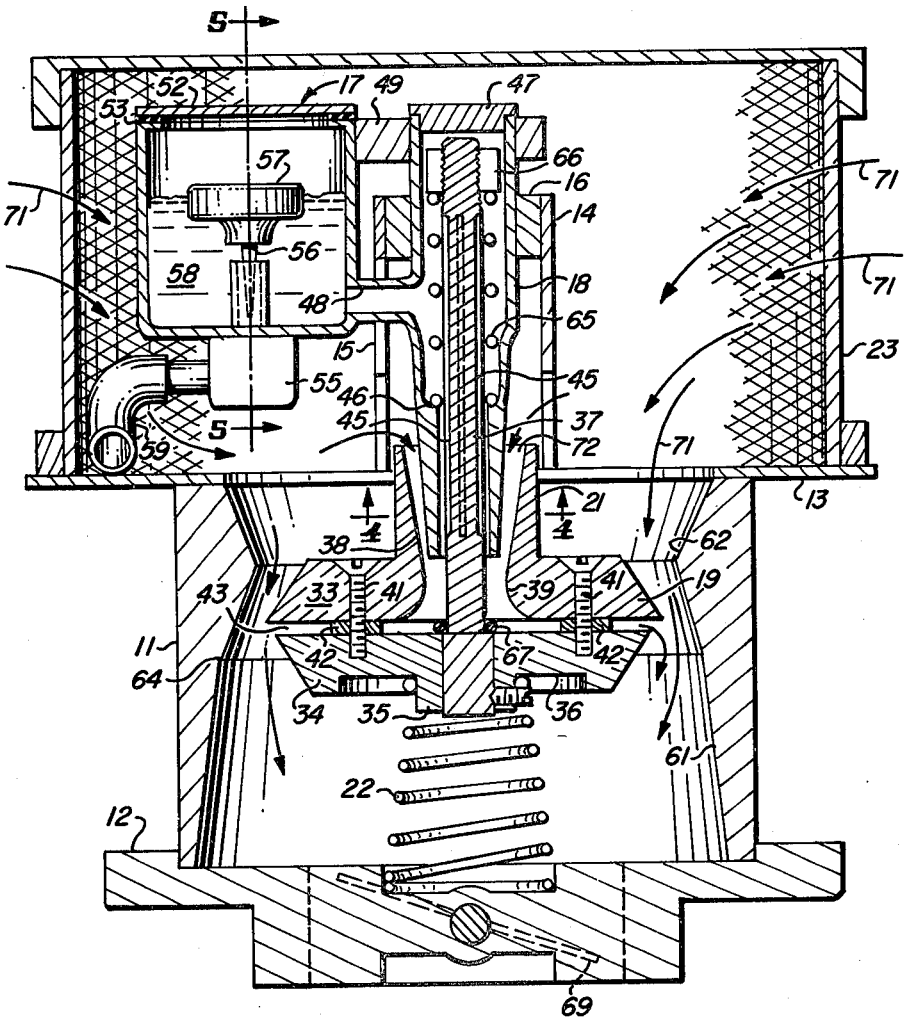
FIG. 3 is a sectional view of the carburetor of FIG. 1 taken along line 3—3 of FIG. 1.

Piston assembly 19 as shown most clearly in FIGS. 2 and 3 comprises an upper piston member 33 and a lower piston member 34.

Lower piston member 34 is in the form of a conical section taken from a solid cone by means of two parallel cuts taken perpendicular to the axis of the cone whereby one of the two cuts forms the upper surface and the other cut forms the lower surface. The lower surface is smaller than the upper surface by virtue of its nearer proximity to the apex of the cone. As shown in FIG. 3 the lower surface is not actually a plane surface but has a centered cylindrical extension 35 surrounded by an annular channel 36, the extension 35 and the channel 36 being incorporated to secure the small upper end of coil spring 22.

Upper piston member 33 has external outlines similar to those of lower member 34 but its parallel plane surfaces are slightly larger in diameter than those of member 34. Also, member 33 is inverted in relationship to member 34 and its centered extension 21 is larger in diameter and length than extension 35.

Both members 33 and 34 have axial centered bores. The bore in lower member 34 is relatively small in diameter and holds the lower end of a metering rod 37 which passes upward through the center of the larger center bore of member 33. The lower end of rod 37 fits tightly in the center bore of member 34 so as to prevent gasoline from leaking through. The center bore of member 33 as defined by the surface 38 identified in FIG. 3 has a minimum bore dimension at a point 39 near the lower surface of member 33. From point 39 surface 38 diverges upwardly as a substantially conical surface and from point 39 downward surface 38 diverges in a rounded beveled fashion to merge with the flat lower surface of member 33.

Upper member 33 and lower member 34 are secured together with their axes aligned as shown in FIGS. 2 and 3 by means of two screws 41 which pass vertically through both members and through two washers 42 which are positioned between the adjacent surfaces of the two members 33 and 34 to cause a separation 43 therebetween. Clearance holes are provided in member 33 for screws 41; in member 34 tapped holes engage the screws.

Figure 4:
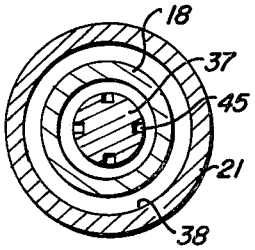
FIG. 4 is a sectional view of a part of the carburetor taken along line 4—4 of FIG. 3.

Metering rod 37 has a threaded upper end 44 and is otherwise cylindrical with four longitudinal grooves 45 equally spaced about its center section, the grooves 45 being visible in FIGS. 2, 3 and 4.

Of the four grooves 45 one extends all the way to the bottom of rod 37, a second terminates a bit higher, the third higher still, and the fourth still higher.

Fuel-metering column 18 is substantially cylindrical except that its lower half tapers down to a reduced diameter at its lower end. Approximately the lower third of its length has a cylindrical center bore which is just sufficiently larger in diameter than rod 37 as to receive rod 37 and allow free longitudinal motion of rod 37 therein. The upper two-thirds of column 18 is substantially hollow and larger in internal diameter than the bore in the lower third section. At the junction of the lower smaller bore with the larger upper opening an internal ledge 46 is formed.

The upper end of column 18 is cylindrical inside and out and is covered by a removable cap 47 which fits snugly inside the upper end of column 18 and has a radial extension at its top which limits its penetration therein. If desired a threaded cap 47 may be employed to be turned into the end of column 18.

Column 18 is integral with reservoir 17 by virtue of a hollow connecting tube 48, tube 48 opening into reservoir 17 near its bottom and into the side of column 18 at a point approximately one-third of the way down from its upper end. Column 18 is further secured to reservoir 17 my means of a bracket 49 which surrounds the upper end of column 18 and is secured to the side of reservoir 17 by means of screws 51 as shown in FIG. 1.

Figure 5:
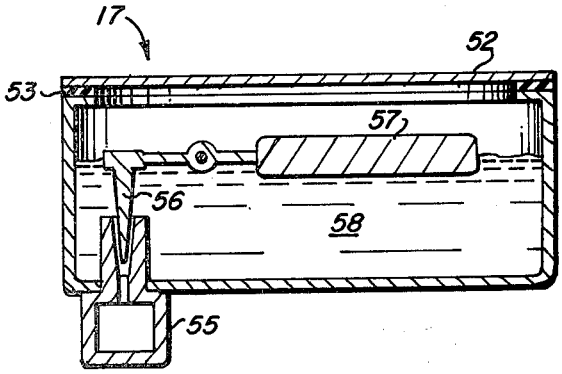
FIG. 5 is a sectional view of the gasoline reservoir employed in the assembly of FIGS. 1 and 3 taken along line 5—5 of FIG. 3.

Reservoir 17 as shown in FIGS. 1, 3 and 5 is in the form of a rectangular box with a flat top cover 52 held in place by screws. A gasket 53 may be employed under the cover 52. Gasoline is delivered to reservoir 17 by a fuel pump through a fuel line 54 which connects to a fitting 55 at the bottom of reservoir 17. Fitting 55 leads upward to a needle valve 56 which is operated by a float 57, the float 57 and needle valve 56 regulating the level of gasoline 58 in reservoir 17. The upper volume of reservoir 17 above the surface of the gasoline is at atmospheric pressure by virtue of a vent 59 which is visible in FIG. 1.

The inside wall 61 of cylindrical body 11 is in the form of a venturi with a minimum diameter at a point 62 located approximately one-fifth of the way down from the top. From point 62 wall 61 is divergent upwardly and downwardly. The degree of divergence is somewhat reduced below a point 64 which is near the center of body 11.

The piston assembly 19 may be secured to column 18 prior to final assembly of carburetor 10 by first inserting rod 37 upwardly through a bore in the lower end of column 18. A coil spring 65 is then inserted through the open upper end of column 18 and over the upper end of rod 37. The lower end of spring 65 is retained by ledge 46. A cylindrical nut 66 is then threaded over the upper end of rod 37 and against the upper end of spring 65. Nut 66 fits inside the upper end of column 18 with just sufficient clearance to permit its free vertical movement therein. Piston assembly 19 is now secured to column 18 and is vertically aligned therewith by virtue of the containment of nut 66 within column 18 at the upper end of rod 37 and by virtue of the containment of the lower portion of rod 37 within the lower bore of column 18. Spring 65 is in compression and urges rod 37 and piston assembly 19 upwardly.

When piston assembly 19 has been thus secured to column 18 the combined assembly may be mounted on plate 13 and secured together with body 11 and throttle plate 12 by means of bolts 24 as shown in FIGS. 1 and 3. Choke lever 29 is then coupled to throttle arm 31 by installing lever 32 as shown in FIG. 1. The spring 22, as shown in FIG. 3, operating between the lower surface of piston member 34 and the upper surface of throttle plate 12 serves the same purpose as spring 65, urging piston assembly 19 upward. In a given implementation of the invention one or the other of the two springs 22 or 65 may be omitted.

Operation

Before the engine operating carburetor 10 is started, piston assembly 19 is held in the fully upward position by springs 22 and 65 so that the lower end of column 18 is forced against an "O-ring" 67 which surrounds rod 37 at its junction with the top surface of piston member 42. Gasoline from reservoir 17 enters column 18 through tube 48 under the action of gravity and surrounds rod 37 filling the slots 45 of rod 37 all the way down to the lower end of rod 37 where it is blocked from further movement formed by "O-ring" 67.

When piston assembly 19 is in this fully-upward position the space 43 between piston members 33 and 34 is at the approximate level of point 62 which is at the minimum dimension of venturi surface 61.

As the engine is started and the gas peddle or lever is moved, throttle arm 31 pivots on its axis 68 to open the butterfly valves 69 and simultaneously through the action of levers 32 and 29 the piston assembly 19 is lowered, thereby breaking the seal of "O-ring" 67 at the lower end of column 18 so that gasoline is admitted from column 18 into the interior of piston assembly 19. During engine operation gasoline and its mixture with air are injected into the carburetor, as will be obvious from the following description. As the engine is turned over by the starter, air is drawn through the air filter 23 and passes downwardly through carburetor 10 as diagrammatically shown by arrows 71. The bulk of the air flow is through the space surrounding the outer surface of piston assembly 19 and inside venturi surface 61. As the air passes the outermost edge of piston member 19, it experiences an increase in velocity and a corresponding decrease in pressure. The reduction in pressure at the edge of the separation 43 between piston members 33 and 34 promotes air-flow through a second path which commences at the upper end of projection 21 through the passage 72 which is bounded by the inside surface 38 of extension 21 and the outside surface of the lower end of column 18. The contours of passage 72 from a venturi which is adjusted automatically as piston assembly 19 moves up or down over the end of column 18. As the air flows downward through this venturi configuration it passes the lower end of column 18 at high velocity and low pressure vaporizing and taking with it the gasoline which is now flowing downward through the slots 45. This rich mixture of air and gasoline passes radially outward through separation 43 to mix again with the main airflow at the peripheries of piston members 33 and 34. At this point of mixture with the main air flow there is a high degree of turbulence owing to the specific construction of the members 33 and 34. More particularly the turbulence is produced by the protrusion of the outer edge of upper member 33 beyond the outer edge of lower member 34 and also by virtue of the sharp conical surfaces of members 33 and 34. The turbulence thus effected produces a thorough mixture of the air and gasoline vapors, such thorough mixing being, of course, highly desirable and essential to the efficient performance of the engine.

As the engine speed picks up, the airflow increases and the reduced air pressure below piston assembly 19 pulls it downward against the force of springs 22 and 65 so that the action of lever 29 is no longer required.

At low engine speeds the downward pull is moderate and piston assembly 19 assumes a position near its upper limit where the periphery of member 33 is nearly on a level with point 62 of surface 61. A minimal space constituting a very small venturi is thus formed at the periphery of assembly 19 so that even at the low volume of air flow prevailing at low engine speeds a high velocity is achieved at this point as required to produce the secondary air-flow inside piston assembly 19 and the turbulence at the edges of member 33.

As engine speed increases the increased vacuum below piston assembly 19 pulls it farther downward so that a larger venturi area is produced around the peripheries of piston members 33 and 34, the larger area accommodating the increased air-flow while maintaining the required air velocity past the peripheries of members 33 and 34. Also, an assembly 19 moves downward relative to the lower end of column 18, the effective cross-sectional area of passage 72 is increased as appropriate to accommodate a higher volume of air through the interior of piston assembly 19, the higher volume of air-flow through passage 72 being required to deliver an increased amount of gasoline to the engine.

The increased flow of gasoline is also effected by the design of the metering rod 37. When piston assembly 19 is in the fully upward position, the small bore at the lower end of column 18 covers the lower end of all four of the grooves 45. An assembly 19 moves downward it uncovers the end of the first groove, then the end of the second, then the third and finally the fourth. Thus, an engine speed increases and with it the demand for more gasoline, the number of grooves 45 available for supplying gasoline increases automatically as piston assembly moves downward.

It will be noted that the simultaneous adjustment of both the primary and secondary venturies and the adjustment of the fuel flow are accomplished through the automatic motion of a single part, namely, the piston assembly 19. Furthermore, the only intimate bearing surfaces involved in this motion are those inside column 18 which is filled with gasoline, the gasoline effectively cleaning and lubricating the moving parts. This important feature is not provided in the prior art devices.

Second Embodiment of the Invention

In a second embodiment of the invention, a modified fuel-metering arrangement is employed. Because the modification involves changes in parts concealed within column 18 and piston assembly 19 the external appearance of the carburetor in the second embodiment is substantially the same as that of the first embodiment as shown in FIG. 1.

Figure 6:
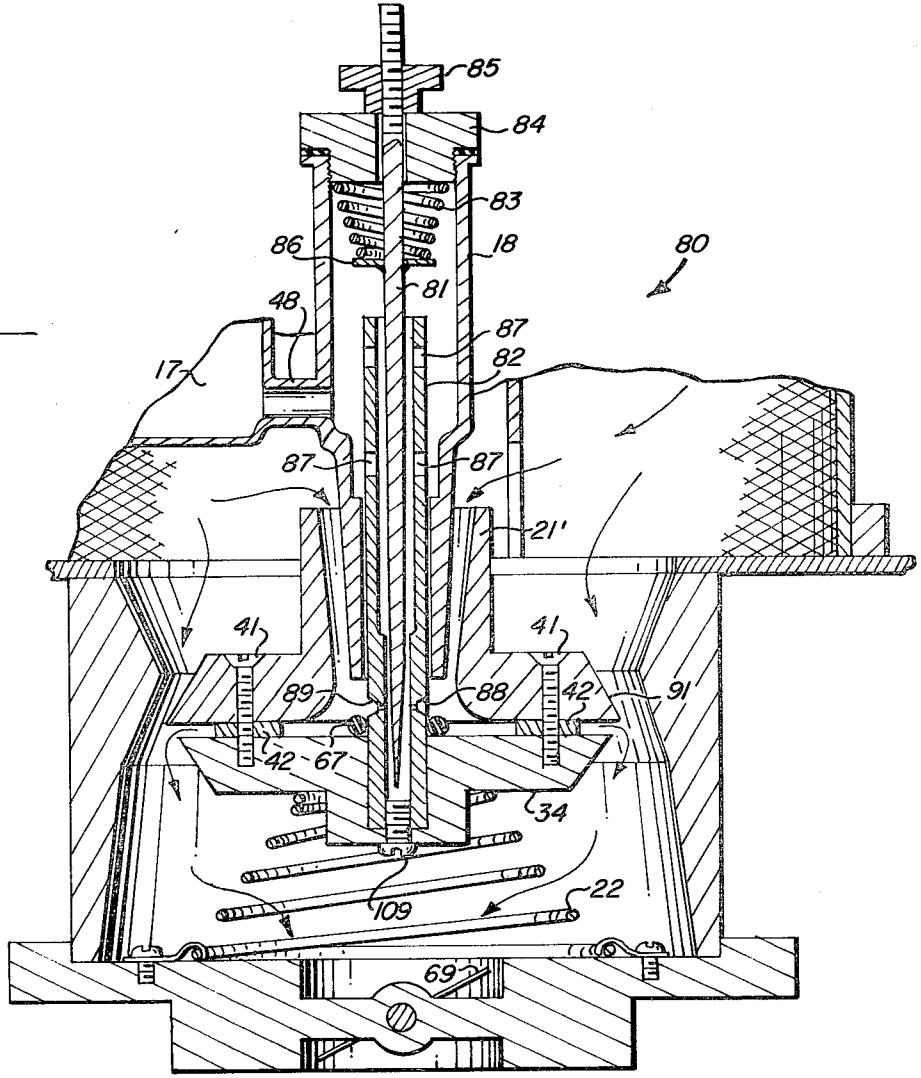
FIGS. 6, 7 and 8 are partial sectional views of further embodiments of the invention in which modified fuel-metering arrangements are employed.

FIG. 6 discloses in sectional view the modified fuel-metering system 80 as employed in the second embodiment. The fuel-metering system 80 comprises a needle 81, a needle chamber 82, a needle-retainer spring 83, a special end cap 84 for column 18, and a needle-adjusting nut 85. Except for the parts 81–85 and except for the absence of the rod 37, the spring 65, the nut 66 and the cap 47 of the first embodiment, the construction of the carburetor 10 is substantially unchanged from the first embodiment.

As shown in FIG. 6, the needle 81 is in the form of a cylindrical rod over the major part of its length. Its upper end is threaded and a retaining washer 86 is secured to needle 81 at a point just below the threaded portion. The lower end of needle 81 is tapered to a rounded tip, the taper being relatively gradual.

Needle chamber 83 has a cylindrical outer surface and it has a cylindrical bore running two-thirds of its length from the top downward. From the lower end of the cylindrical bore a moderately tapered bore runs to the lower end of the chamber 82, the small diameter of the tapered bore being at the bottom of chamber 83. A number of holes 87 penetrate the walls of the chamber 82 along the upper one-third of its length. The lower end of chamber 82 fits tightly inside a cylindrical recession in the center of lower piston member 34. Surrounding chamber 82 at its junction with member 34 is an "O-ring" seal 67 is employed also in the first embodiment, and above the seal 67 is an annular groove 88. Four holes 89 penetrate from the bottom of the groove 88 to the interior of chamber 82, the holes 89 being spaced evenly at quadrants about the circumference of the groove 88.

The needle 81, the spring 83, the cap 84 and the nut 85 are assembled together by first slipping spring 83 over the threaded end of needle 81 then passing the threaded end of needle 81 through a clearance hole in the center of cap 84, and finally threading on nut 85.

The modified piston assembly 91 carrying needle chamber 82 is assembled to column 18 in the manner described for the first embodiment, the outer surface of chamber 82 fitting snugly but freely slidable within the lower bore of column 18. The needle 81 as assembled with parts 83, 84, 85 and 86 is then inserted, its lower pointed end penetrating the lower tapered bore of chamber 82, and the threaded lower part of cap 84 turning into the tapped upper end of column 18. The vertical position of needle 81 is now adjustable by means of nut 85 which may be turned clockwise to move needle 81 upward against the retaining force of spring 83.

In the operation of the modified fuel metering system of FIG. 6, fuel from reservoir 17 flows into column 18 through tube 48, surrounds chamber 82 and flows through the holes 87 to the interior of chamber 82. Inside chamber 82, the fuel flows downward around needle 81 at a rate controlled by the vertical position of needle 81 and the consequent clearance between the surfaces of the tapered lower end of needle 81 and the tapered bore of chamber 82. At the bottom of chamber 82, the fuel flows through the holes 89 to mix with air in the first venturi. It will be appreciated that as the piston assembly 91 moves upward, the chamber 82 moves with it while the needle 81 remains stationary. As the chamber 82 thus moves upward with reduced engine speed the clearance between needle 81 and the bore of chamber 82 is reduced so that the supply of fuel is diminished as appropriate for the operation of the engine. The relative dimensions and degrees of taper of the needle 81 and the tapered bore of chamber 82 are such that as the chamber 82 moves upward the space between the two tapered surfaces is diminished gradually and the rate of closure in relationship with the movement of the piston assembly 91 is consistent with the reduced demand for fuel.

While the main flow path of the fuel is inside chamber 82, a very small amount flows between the outer surface of chamber 82 and the inner surface of the lower bore of column 18. This minimal flow of fuel washes and lubricates these bearing surfaces so that again as in the case of the first embodiment all bearing surfaces are cleaned and lubricated in this manner in accordance with the stated objects of the invention.

Description of the Third Embodiment

Figure 7:
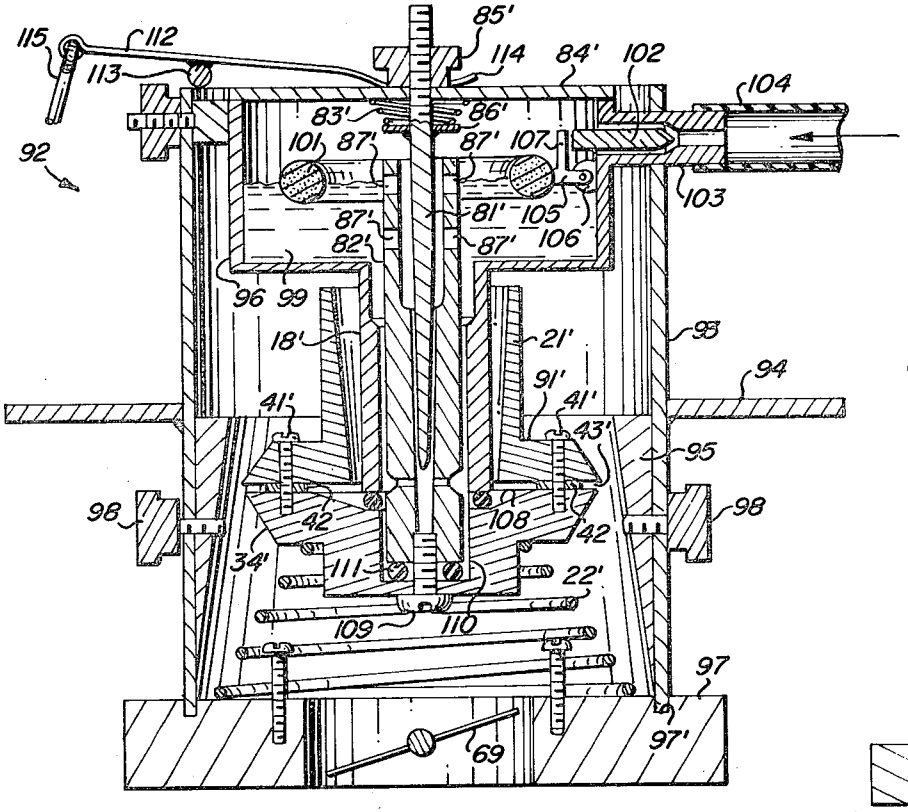

In yet another embodiment of the invention an improved carburetor 92 is provided as shown in sectional view in FIG. 7. The carburetor 92 comprises a carburetor body 93 with an air-filter shelf 94, a tapered venturi ring 95, a fuel reservoir 96 integral with a fuel-metering column 18', a modified piston assembly 91', a needle 81', a needle chamber 82', and a coil spring 22'. The carburetor body 93 is mounted on a throttle plate 97.

Many of the parts employed in the third embodiment are similar to or the same as parts employed in the second embodiment of FIG. 6. Such parts are identified by the primed numbers. Carburetor 92 incorporates the fuel-metering and the fuel-mixing venturi arrangements shown in FIG. 6 but utilizes in addition therewith a modified mounting structure and fuel reservoir design. The particular construction of FIG. 7 provides improved manufacturability and is also more easily and effectively adjustable for optimum performance.

Carburetor body 93 is a simple cylindrical metal shell mounted upright and seated inside a circular slot 97' on the top side of the throttle plate 97. The air-filter shelf is a flat disc with a circular center opening that fits over the body 93. It is welded in a horizontal position surrounding body 93 at approximately its half-way point. A conventional air-filter may be mounted on shelf 94.

The venturi ring 95 has a cylindrical outer surface that fits snugly but freely moveably inside body 93. Its inside surface is tapered in a conical contour from a thick upper edge to a relatively thin lower edge approximating the lower part of the surface 61 of FIG. 3. Ring 95 is secured in position by means of two or more thumb screws 98 which pass through inclined slots in the walls of body 93 and turn into threaded holes in the ring 95. It may be raised or lowered by loosening the screws 98 and rotating clockwise or counterclockwise about the axis of the body 93. Ring 95 in cooperation with piston 91' forms the large outer venturi which is self-adjusting with engine speed.

The fuel reservoir 96 and the integral metering column 18' are evolved from column 18 of FIG. 6 simply by enlarging the top portion of column 18. The need for a separate reservoir is thus eliminated. The cap 84' is similarly an extension of the cap 84 of FIG. 6, but now in addition to providing support for the needle 81' it also serves as a removable cover for reservoir 96.

The level of the gasoline in reservoir 96 is controlled by a doughnut-shaped float 101 operating a needle-valve 102. The needle-valve 102 is mounted in a horizontal valve stem 103 which extends from the wall of reservoir 96 and passes through a slot in body 93. A fuel delivery line 104 from the fuel pump is attached to the extending end of stem 103. Float 101 is pivotally attached by means of a pivot arm 105 which extends radially outward from the periphery of float 101 to a pivot pin 106 which is attached to the wall of reservoir 96 at a point directly below the stem 103. A vertically extending arm 107 rising from the top side of pivot arm 105 rocks outward to close needle valve 102 as the fuel 99 rises to the controlled level.

The fuel-metering column 18' serves in the same manner as the lower part of the column 18 of FIG. 6, its inside surface acting as a guide for the needle chamber 82', and its outer surface serving as one wall of the small venturi.

The lower piston member 34' of assembly 91' is similar to member 34 but it has a tapered central depression 108 in its upper surface. The depression 108 reduces friction for air which passes downward through the small venturi and turns to flow outward through separation 43'. Lower member 34' also has a clearance hole for a screw 109 which passes upward through the center of member 34' and threads into a center-hole in the lower end of needle chamber 82' to secure the chamber 82' to inside the center bore 110 of member 34'. A washer or "O-ring" 111 is placed at the bottom of bore 110 under the end of chamber 82' to seal and prevent fuel leakage around screw 109. In all other respects, assembly 91' is the same as assembly 91.

As in the arrangement of FIG. 6, piston assembly 91' is urged upward by a coil spring 22' acting between the bottom of assembly 91' and throttle plate 97 and is moved downward in proportion to engine speed so that the large venturi at the periphery assembly 91' and the small venturi formed between its upper extension and the outer surface of column 18' are automatically adjusted to accommodate the changing volume of air.

The needle 81' is mounted and adjusted by means of a spring 83' confined between a retaining washer 86' and the cap 84' in cooperation with a thumb screw 85' in the same kind of arrangement as described earlier for FIG. 6.

An automatic choking arrangement for cold starting is provided in the form of a lever 112 which operates about a fulcrum 113 to raise needle 81'. A fork 114 at one end of lever 112 and on one side of fulcrum 113 is raised when the other end of lever 112 is lowered by means of a linkage 115 which is pulled downward by a bimetal spring. The fork 114 fits under the edges of nut 85' to lift nut 85' and needle 81' as lever 112 is operated.

Description of the Fourth Embodiment

Figure 8:
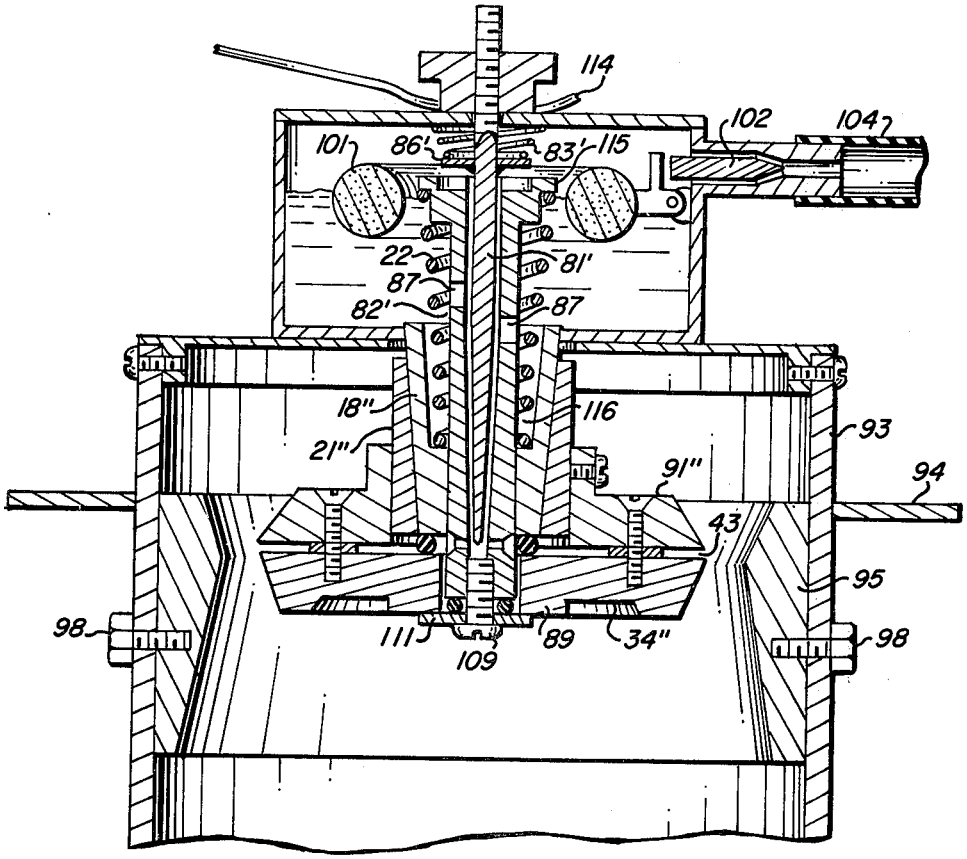

The embodiment illustrated in FIG. 8 is a modification of the carburetor shown in FIG. 7 but differs therefrom by placing spring 22' between a ledge 115 threadedly mounted on the end of needle chamber 82' and an aperture or well 116 in fuel-metering column 18''. As shown, the upper extension 21'' of the piston assembly 91'' is adjustably mounted on the assembly for controlling the size of the venturi formed between the fuel metering column and the upper extension of the piston assembly.

The difference of the carburetor shown in FIG. 8 over that of FIG. 7 permits a shorter overall length of the carburetor structure.

It should be noted that the fuel injection systems disclosed employ a float chamber above the fuel metering portions of the needle valve that supplies fuel to the venturi sections of the carburetor. This feature aids in its performance and increases mileage of a gasoline driven automobile utilizing this type of carburetor.

Additionally, the disclosed carburetors employ fuel injection even though a float valve is used which provides much faster cold starts of an associated gasoline engine than prior art structures since an instant supply of gasoline is available the moment the piston of the carburetor moves downwardly under action of engine manifold vacuum, thereby releasing the needle valve to let gasoline flow to the venturi sections formed by the piston and the walls of the carburetor.

The judicious design and proper balance between the dimensions, proportions and contours of the piston assembly 19 or 91, body 11, column 18 and the parts of the fuel injection metering systems of the various embodiments results in an improved carburetor which operates efficiently and effectively under all operating conditions including starting, idling, cruising, accelerating and heavy loads. Such versatile performance is achieved primarily as a result of the two automatically self-adjusting venturi arrangements incorporated in the carburetor design, the first venturi being formed between the inner surface of extension 21 of piston member 33 and the outer surface of the lower end of fuel-metering column 18, and the second venturi being formed between the outer edges of piston members 33 and 34 and the inside surface of carburetor body 11. Both are urged toward a closed position against the vacuum produced by the engine and by the air-flow around the piston assembly 19 or 91 so that a high or sonic air flow is achieved under all operating conditions. In addition, an exceptionally large mixing area is achieved by virtue of the radial flow path from the bottom of the metering column 18 through the separation 43 between piston members 33 and 34 to the large venturi area surrounding these members. An additional benefit in the form of unusually high turbulence is achieved through the sharp contours of piston member 33 and its radial overhang beyond member 34 at the separation 43. The consistently high air velocity, the large mixing area, the turbulence, and the two stages of fuel-and-air mixing account for the efficient mixing action achieved.

The construction of the primary and secondary venturi arrangements and their cooperative operation with the self-adjusting fuel-metering system maintain the proper balance of fuel and air under all conditions from idle to high speed and heavy loads. This balanced flow of fuel and air also contributes to the stability of the piston assembly without flutter or oscillation through rapid changes produced by acceleration of engine speed.

Field tests have demonstrated that gasoline mileage is approximately doubled when compared with the performance of a conventional carburetor on the same engine. An air-fuel ratio of 18 to 1 is achieved and tolerated without difficulty.

A significantly improved carburetor is thus disclosed in accordance with the stated objects of the invention, and the shortcomings of the prior art are effectively overcome. Although but a few embodiments have been illustrated and described, it will be apparent to those skilled in the art that various changes and modifications may be made therein without departing from the spirit of the invention or from the scope of the appended claims.

What is claimed is:

1. A carburetor comprising:

a hollow mixing chamber provided with a fuel inlet means at one end and a fuel outlet means at the other end, the interior of said hollow chamber forming a venturi shaped opening tapering from a minimum diameter at a point along its length toward a greater diameter opening at each end of said chamber, piston means movably mounted in said opening for movement longitudinal thereof, said piston means comprising along at least a part of its length a segment of a cone, whereby movement of said piston means within said opening forms a first venturi between its outer periphery and the inside surface of said opening, a needle valve arranged within said fuel inlet means, said needle valve being fixedly mounted on said carburetor and extending within said fuel inlet means, said piston means having a hollow extension for movement around and along the outer periphery of one end of said fuel inlet means, the inside surface of said hollow extension forming with said outside surface of said fuel inlet means a passageway forming a second venturi, biasing means attached to said carburetor and engaging said piston means for biasing said piston means toward said fuel inlet means, said needle valve controlling the flow of fuel through said fuel inlet means, said opening and around said piston means and into said fuel outlet means, and air inlet means connected to said first venturi and said passageway, said air inlet means transmitting air into said passageway for mixing with the fuel ejected from said fuel inlet means and separately into said first venturi for mixing air with the fuel and air mixture from said fuel inlet means over at least a part of the outer periphery of said piston means.

2. A carburetor comprising:

a hollow mixing chamber provided with a fuel inlet means at one end and a fuel outlet means at the outer end, the interior of said hollow chamber forming a venturi shaped opening tapering from a minimum diameter at a point along its length toward a greater diameter opening at each end of said chamber, piston means movably mounted in said opening for movement longitudinal thereof, said piston means comprising along at least a part of its length a segment of a cone, whereby movement of said piston means within said opening forms a first venturi between its outer periphery and the inside surface of said opening, a needle valve arranged within said fuel inlet means, said needle valve being fixedly mounted on said carburetor and extending within said fuel inlet means, said fuel inlet means being fixedly mounted on said piston means for movement therewith, a fuel reservoir connected to said fuel inlet means for gravity feed thereinto, said piston means having a hollow extension for movement around and along the outer periphery of one end of said fuel inlet means, the inside surface of said hollow extension forming with said outside surface of said fuel inlet means a passageway forming a second venturi, biasing means attached to said carburetor and engaging said piston means for biasing said piston means toward said fuel inlet means, said needle valve controlling the flow of fuel through said fuel inlet means, said opening and around said piston means and into said fuel outlet means, and air inlet means connected to said first venturi and said passageway, said air inlet means transmitting air into said passageway for mixing with the fuel ejected from said fuel inlet means and separately into said first venturi for mixing air with the fuel and air mixture from said fuel inlet means over at least a part of the outer periphery of said piston means.

3. The carburetor set forth in claim 2 wherein:

said fuel inlet means extends into said reservoir.

4. The carburetor set forth in claim 3 wherein:

said fuel inlet means is provided with at least a pair of apertures spacedly positioned along its length for providing passageways for fuel flow from said reservoir into said fuel inlet means.

* * * * *